US005210985A

United States Patent [19]

Hsu

[11] Patent Number: 5,210,985

[45] Date of Patent: May 18, 1993

[54] FIRE ESCAPING ROOM

[76] Inventor: Chi-Lin Hsu, 5F-5, No. 245, Pa-Der Road Section 2, Taipei, Taiwan

[21] Appl. No.: 655,748

[22] Filed: Feb. 15, 1991

[51] Int. Cl.[5] ..... E04H 9/00

[52] U.S. Cl. ..... 52/169.6; 52/106; 109/1 R

[58] Field of Search ..... 52/169.6, 106; 109/1 S, 109/1 R, 1 V

[56] References Cited

U.S. PATENT DOCUMENTS 4,126,972 11/1978 Silen ..... 52/169.6

4,631,872 12/1986 Daroga ..... 52/169.6

*Primary Examiner*—Richard E. Chilcot, Jr.

*Assistant Examiner*—Wynn E. Wood

*Attorney, Agent, or Firm*—Darjen International Patent Office

[57] ABSTRACT

A fire-escaping room capable of providing basic living necessities for persons in case of a fire, the room being constructed by concrete to form a close space, including a fire-proof door serving as an only entrance/exit of the room and capable of preventing outdoor heavy smoke from entering the room, several vent holes being formed on the fire-proof door, a slide block set being operable in the room to close or open the vent holes; a manually operated air pump disposed in the room, having a reciprocally movable diaphragm for changing the volume of the air pump so as to intermittently suck external air through an externally extending ventilating pipe into the fire-escaping room; and a sprinkling pipe disposed around vertical room walls of the room, the sprinkling pipe being formed with a plurality of sprinkling holes and connected with a water supply incoming pipe to be supplied with water therefrom, whereby when a manually operated controlling valve disposed in the room is located at a water flow conducting position, the water in the incoming pipe flows into the sprinkling pipe to be sprinkled from the sprinkling holes onto the vertical room walls to lower the temperature in the fire-escaping room.

2 Claims, 8 Drawing Sheets 50
48
40
46
50
42
48
52
12
36
46
50
58
64
64
64
82
82
56
80
76
62
56
60
78
68
82
82
70
66
72
74
84

FIRE ESCAPING ROOM

BACKGROUND OF THE INVENTION

The present invention relates to a fire-escaping room capable of providing basic living necessities for a person in case of a fire, and more particularly to a fire-escaping room (especially to a fire-escaping bath room) possessing functions of isolating the fire and heavy smoke, supplying fresh air and sprinkling water for lowering the temperature.

In modern cities, the density of population is quite large and the construction site is rare. Therefore, high buildings for residences and offices are everywhere. However, in case a fire takes place in such high buildings, the persons therein are often unable to escape from the fire site quickly and the heavy smoke produced in the fire site, which is composed of high density of carbon oxide gas, and the toxic gas produced in burning of the plastic product will greatly threaten the persons with death. According to the statistic data, in the U.S., there are about six thousand people killed by fire in each year.

The escaping way for the persons living in a high building is quite probably obstructed by strong fire and heavy smoke in case of a fire. For example, if the persons use an elevator to escape, the elevator will probably fail due to power cut, making the persons trapped therein. In fact, it is very dangerous to use an elevator for escaping from a fire site. A safer manner of escaping from a fire site is to escape by way of a safety stair. However, the safety stair is also probably blocked by intruding fire and/or spreading heavy smoke so that the persons choosing the safety stair for escaping might die for breathing excessive heavy smoke and being lacking in oxygen or die for fainting away and getting burned by the fire.

Therefore, it is needed to construct a fire-escaping room in the residence, office or factory, which in case of a fire can isolate the fire and heavy smoke and provide the persons with a shortest escaping way so as to protect the persons and keep them safe. The persons can leave the fire site at ease and safely after the fire is extinguished and the heavy smoke is dissipated.

SUMMARY OF THE INVENTION

It is a primary object of this invention to provide a fire-escaping room which can provide basic living necessities for a person in case of a fire and can effectively isolate the fire and heavy smoke and supply fresh air and sprinkle water for lowering the in-room temperature if necessary.

It is a further object of this invention to provide the above fire-escaping room which is constructed together with the bath room and/or toilet room of a general residence, office or factory and used along therewith whereby at normal time, it serves as a general bath room and/or toilet room, while in case of a fire, it provides the escaping persons with a shortest escaping way to the fire-escaping room so as to lower the possibility of danger to the persons when escaping.

According to the above objects, the present fire-escaping room is disposed in a general construction constructed by concrete or other fire-proof constructive materials, including room walls made of fire-proof material such as concrete; a fire-proof door capable of effectively isolating the outdoor fire and heavy smoke; a manually operated air pump for the indoor person to suck external fresh air into the room with hand, the air pump sucking air into the room through a ventilating pipe embedded in the wall and extended to the top of the building or the ground for the indoor person to breathe; and a set of sprinkling pipe disposed around the room and connected with the water supply system of the building so that in case the in-room temperature is too high, the indoor person can open a controlling valve, making the water in the water supply system flow into the sprinkling pipe to be sprinkled onto the walls and floor for effectively lowering the in-room temperature.

The fire-proof door is the only entrance/exit of the fire-escaping room and is connected to a door frame by several hinges so that it can be freely opened or closed. The outer periphery of the door frame is associated with the fire-proof room wall while the inner periphery of the door frame is formed with an inward projecting step portion which can airtightly contact with the fire-proof door. A frame-shaped sealing member made of fire-proof material is disposed between the contact surfaces thereof to effectively stop the heavy smoke from intruding through the clearance between the door frame and fire-proof door into the fire-escaping room. Both the door frame and the fire-proof door are made of fire-proof material such as metal, etc. with excellent fire-proof character. The inner space of the fire-proof door is filled with light and high temperature-resistant thermally insulating material such as high aluminum fiber blanket, etc. to reduce the weight of the fire-proof door and increase the fire-resistance and heat-insulating effect thereof.

Several vent holes are formed on the fire-proof door adjacent to the bottom thereof for ventilating the fire-escaping room. An indoor manually operated slide block set is slidable between a vent hole-closing position and a vent hole-opening position. At normal times, the slide block set is located at the opening position to ventilate the fire-escaping room. While in case of a fire, the slide block set is located at the closing position to prevent the outdoor heavy smoke from diffusing into the fire-escaping room.

DETAILED DESCRIPTION OF THE PREFERRED EMBODIMENT

Figure 1:
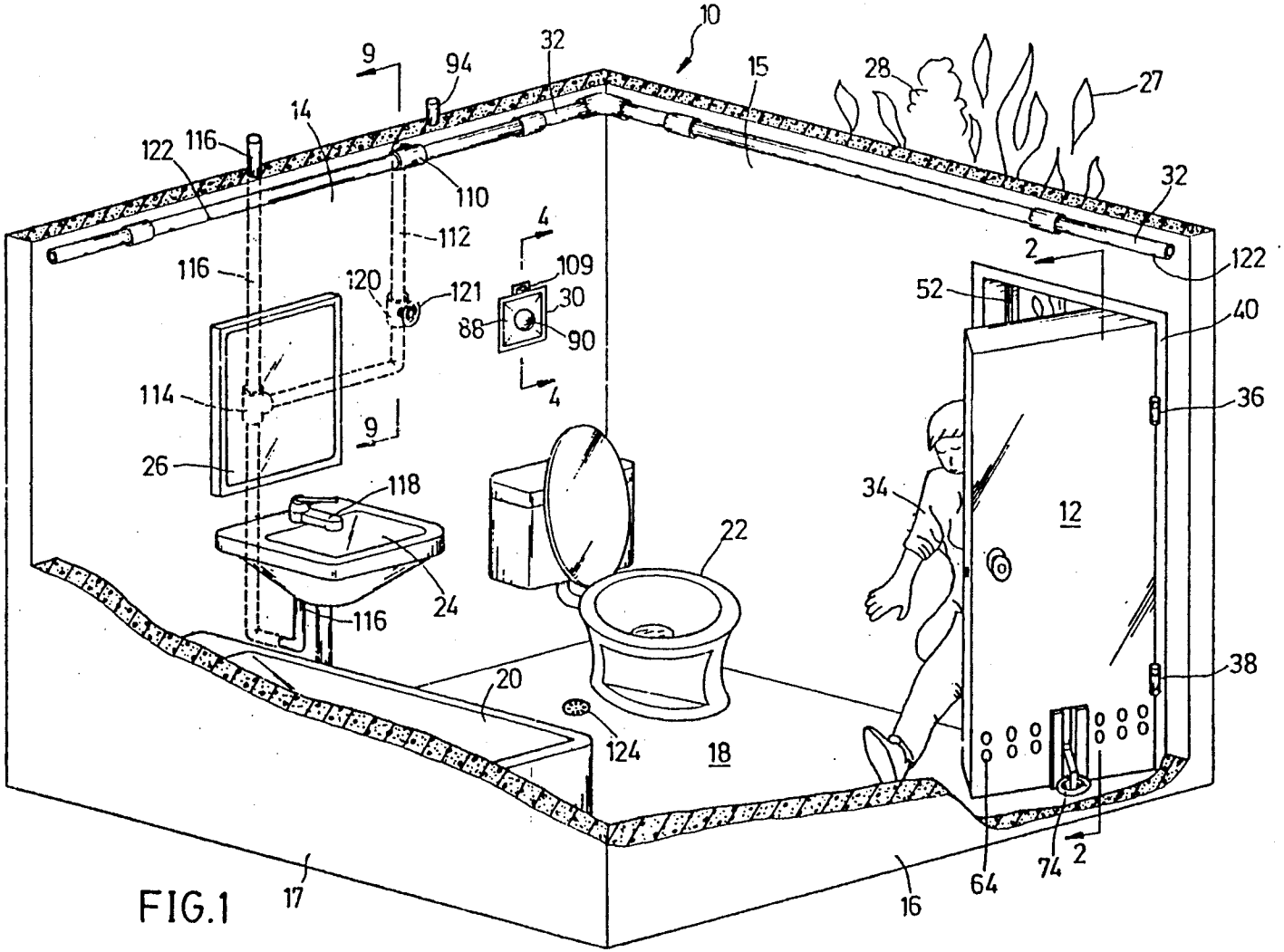
FIG. 1 is a perspective view of the fire-escaping room of this invention, wherein the roof and a part of the wall of the room is removed to show that an escaping person is opening the fire-proof door to enter the room.

Please first refer to FIG. 1. The fire-escaping room 10 of this invention includes a fire-proof door 12 as an entrance/exit and four walls 14 through 17, a floor 18 and a roof (not shown), which define a space isolated from the external environment. The room 10 is provided with a water supply system. Therefore, the fire-escaping room 10 can be constructed together with a bath room and/or toilet room of a general residence, office or factory and used along therewith. Thus, a conventional bath tub 20, toilet bowl 22, basin 24 and mirror 26 can be disposed in the fire-escaping room 10 or be omitted. The walls 14 through 17, floor 18 and roof are constituted by fire-proof material such as concrete and other fire-proof constructive materials.

The fire-proof door 12 after being closed, can thoroughly isolate the outdoor fire 27 and vital heavy smoke 28 and protect a person in the room 10 from being hurt by the fire 27 and smoke 28. A manually operated air pump 30 is disposed in the room 10. In case the person in the room 10 feels that the air in the room 10 is insufficient, he/she can use the air pump 30 to suck the external air into the room 10 for him/her to breathe. Moreover, a sprinkling pipe 32 is provided in the room 10. The sprinkling pipe 32 is connected to a water supply incoming pipe 116 by a connecting pipe 112 embedded in the wall 14 and shown by dotted lines, whereby if the person in the room 10 feels that the temperature therein is too high and uncomfortable, he/she can employ the sprinkling pipe 32 to sprinkle water onto the walls 14 through 17 and the floor 18 for reducing the temperature in the room 10 so as to avoid any ill affection on the person or persons in the room 10.

Referring to FIG. 1, when a fire takes place outside the room 10, any person 34 can open the fire-proof door 12 and enter the room 10 for temporary escape from the fire. Besides the fire-proof door 12 can isolate the outdoor fire 27 and heavy smoke 28, the air pump 30 and sprinkling pipe 32 can provide complemental air and reduce the in-room temperature so as to within a certain period of time prevent the person 34 in the room 10 from getting hurt.

Figure 2:
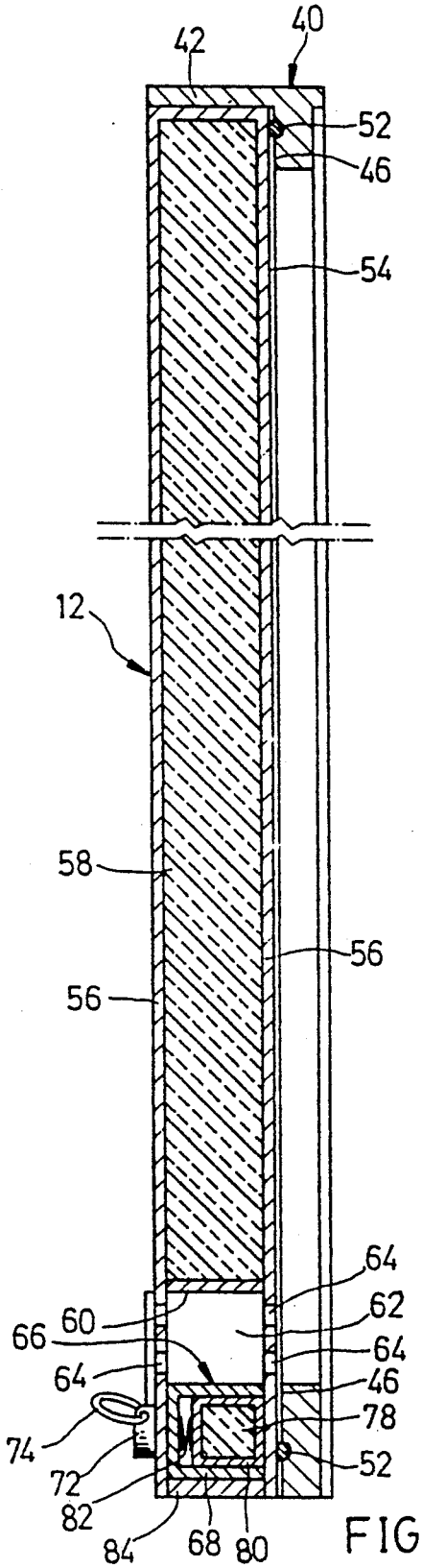
FIG. 2 is an enlarged sectional view taken on line 2—2 of FIG. 1, showing both the fire-proof door and the door frame therefor to clearly illustrate the close state of the fire-proof door.
Figure 3:
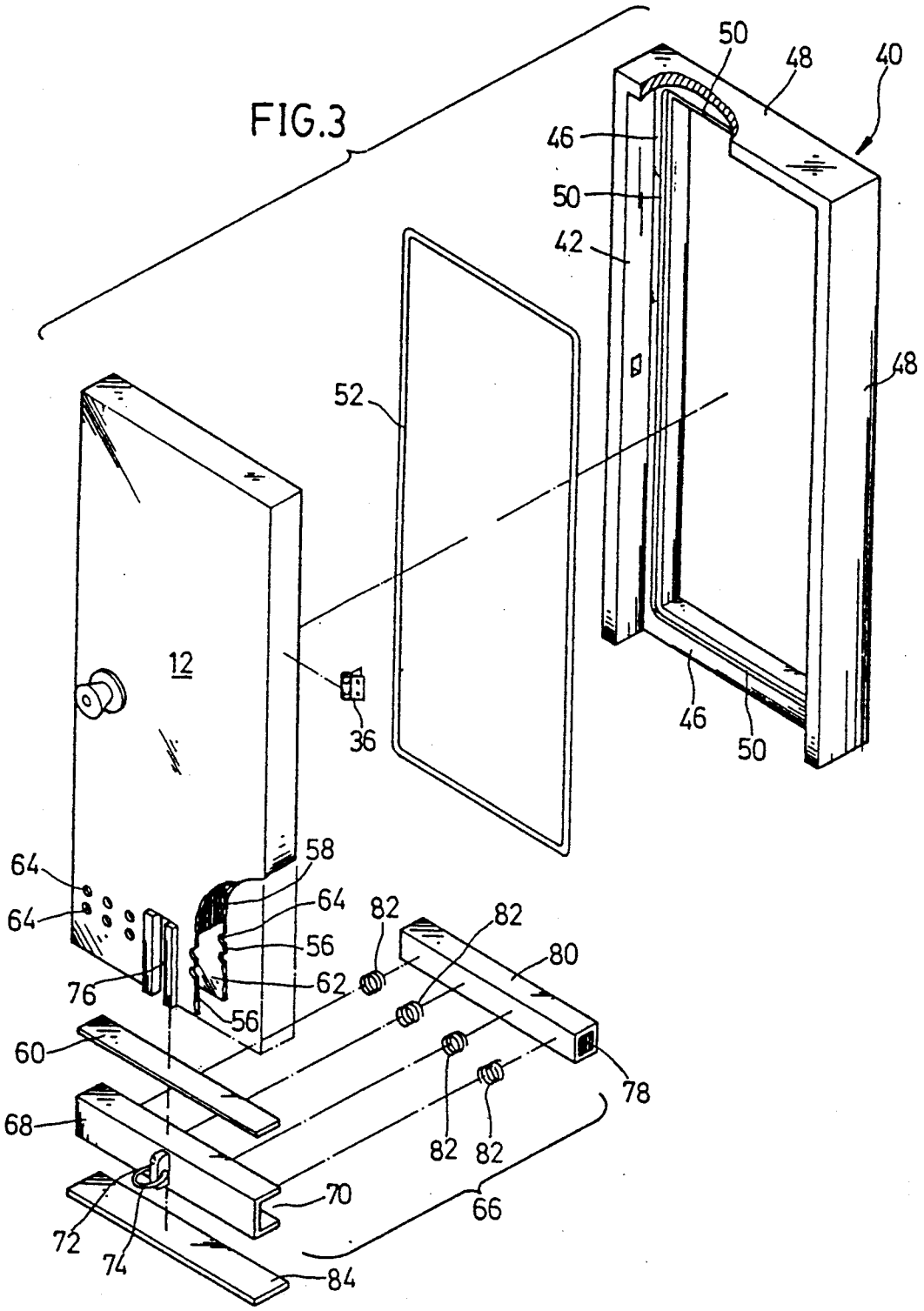
FIG. 3 is a perspective exploded view of the fire-proof door and the door frame of the present invention, the fire-proof door and door frame being partially sectional for clearly showing the structure thereof.

Please refer to FIGS. 1, 2 and 3. The fire-proof door 12 which is the only entrance/exit of the fire-escaping room 10 is rotatably mounted on a door frame 40 fixed on the wall 15 by hinges 36 and 38 so that the fire-proof door 12 can be pushed open or closed up horizontally. The door frame 40 is made of fire-proof material such as metal, etc. and the outer periphery 48 of the door frame 40 is airtightly jointed with the concrete structure of the wall 15 while the inner periphery 42 of the door frame 40 defines a rectangular space capable of accurately receiving the fire-proof door 12. An inward perpendicularly projecting step portion 46 is formed on the inner peripheray 42 of the door frame 40 and a continuous frame-shaped groove 50 is formed along the step portion 46 whereby a corresponding frame-shaped sealing member 52 is partially tightly fitted in the frame-shaped groove 50. Therefore, when the fire-proof door 12 is closely shut down as shown in FIG. 2, a part of the outer surface 54 of the fire-proof door 12 airtightly abuts against the sealing member 52 so as to prevent any outdoor heavy smoke from diffusing into the fire-escaping room 10 through the clearance between the fire-proof door 12 and the door frame 40. The sealing member 52 is made of high temperature-resistant and elastic material such as silicone rubber, etc.

Figure 8:
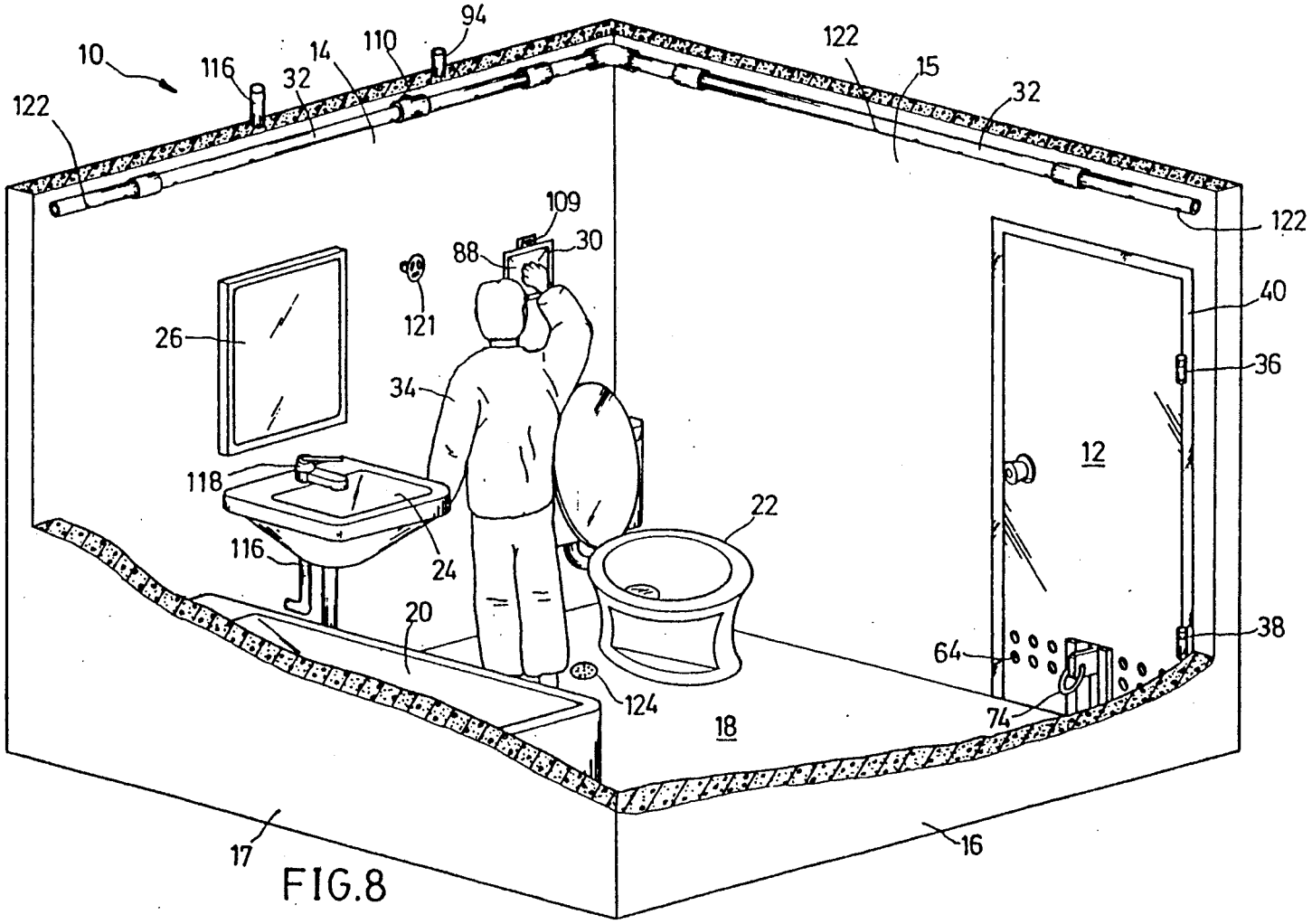
FIG. 8 is a view according to FIG. 1, wherein the escaping person has entered the fire-escaping room and is manually applying the air pump to suck the outdoor air into the room.
Figure 10:
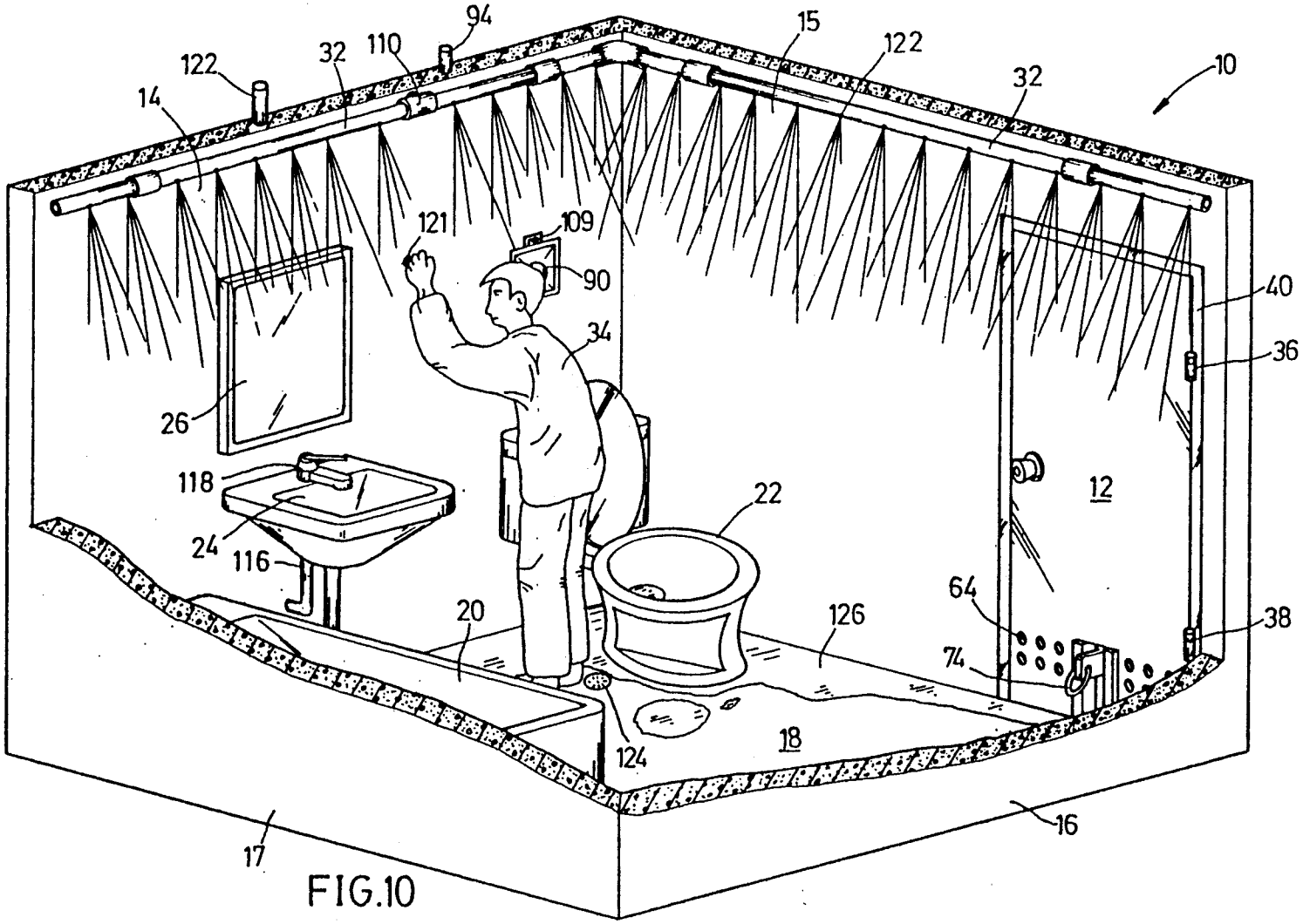
FIG. 10 is a view according to FIGS. 1 and 8, wherein the escaping person is applying the sprinkling pipe to sprinkle water onto the walls of the room for decreasing the temperature therein.

The fire-proof door 12 is constructed by a metal outer casing 56 which wraps an inner thermally insulating layer 58 so as to reduce the weight of the fire-proof door 12 and increase the heat-insulating effect. The thermally insulating layer 58 is made of light and high temperature-resistant heat-insulating material, e.g., high aluminum fiber. However, the space inside the metal casing 56 is not completely filled up with the thermally insulating layer 58. Adjacent to the bottom of the casing 56 is disposed an inner compartmentalizing board 60 which divides the inner space into an upper chamber filled with the thermally insulating layer 58 and a lower chamber 62. On a part of the casing 56, which defines the lower chamber 62 are formed several vent holes 64 for ventilation of the fire-escaping room 10. A spring-type of manually operated slide block set 66 is arranged in the lower chamber 62 and can be operated indoors to vertically slide between a first position at which the slide block set 66 closes the vent holes 64, and a second position at which the slide block set 66 opens the vent holes 64. As shown in FIG. 2, when the slide block set 66 is located at the lower second position, all the vent holes 64 are open to ventilate the fire-escaping room 10 so that it can serve as a bath room and/or toilet room at normal times. While in case that a fire takes place, as shown in FIGS. 8 and 10, the slide block set 66 is pulled upward toward the upper first position to close all the vent holes 64 for preventing the outdoor heavy smoke from getting in the fire-escaping room 10.

The slide block set 66 includes an outer frame 68 one end of which has an opening 70 and the other end of which is provided with a lug 72 through which a pull ring 74 is disposed. The lug 72 and pull ring 74 extend through a vertical guide groove 76 formed on the bottom portion of the casing 56 so that a person can pull the pull ring 74 with his/her hand indoors, making the lug 72 together with the outer frame 68 vertically move along the guide groove 76 within the second chamber 62. A hollow column 80 filled with a thermally insulating layer 78 is located in the outer frame 68 through the opening 70, and several compression springs 82 are disposed between the outer frame 68 and the column 80 whereby the springs 82 can push the outer frame 68 and the column 80 away from each other and make the outer frame 68 and the column 80 respectively closely abut against the inner walls of the outer casing 56. Therefore, in case a fire occurs, the person entering the fire-escaping room 10 can upwardly pull the pull ring 74 by hand to move the slide block set 66 toward the vent holes 64 and close the same. By means of the pushing force of the springs 82, the outer frame 68 and column 80 of the slide block set 66 respectively tightly abut against the inner surfaces of the outer casing 56, on which the vent holes 64 are formed to thus effectively prevent the outdoor heavy smoke from diffusing into the room 10. A bottom board 84 is fixed at the bottom of the outer casing 56 of the fire-proof door 12 to avoid dropping out of the slide block set 66.

Figure 4:
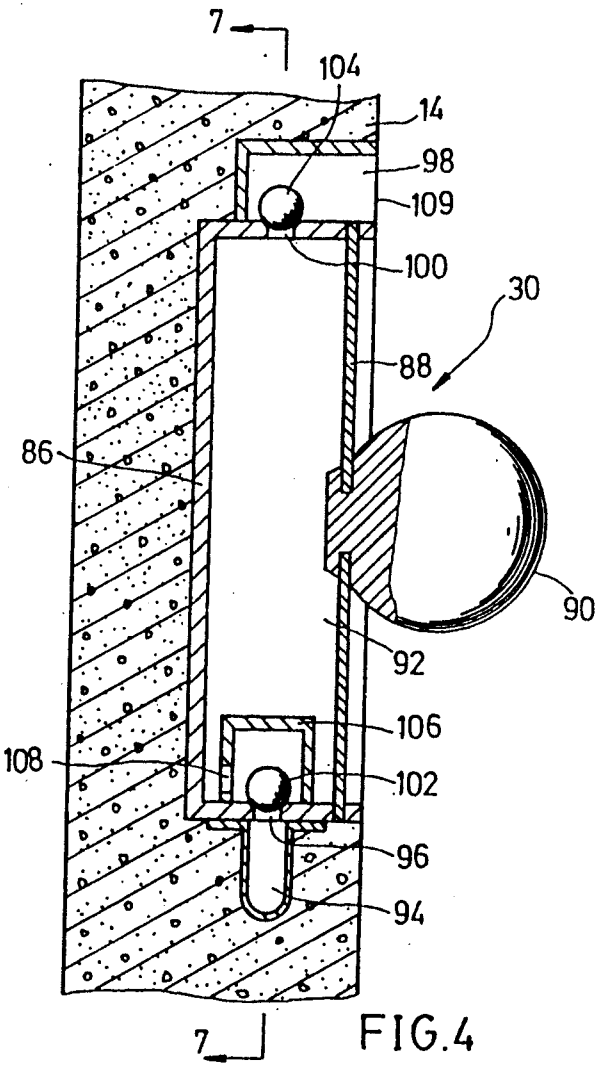
FIG. 4 is an enlarged sectional view taken on line 4—4 of FIG. 1.
Figure 7:
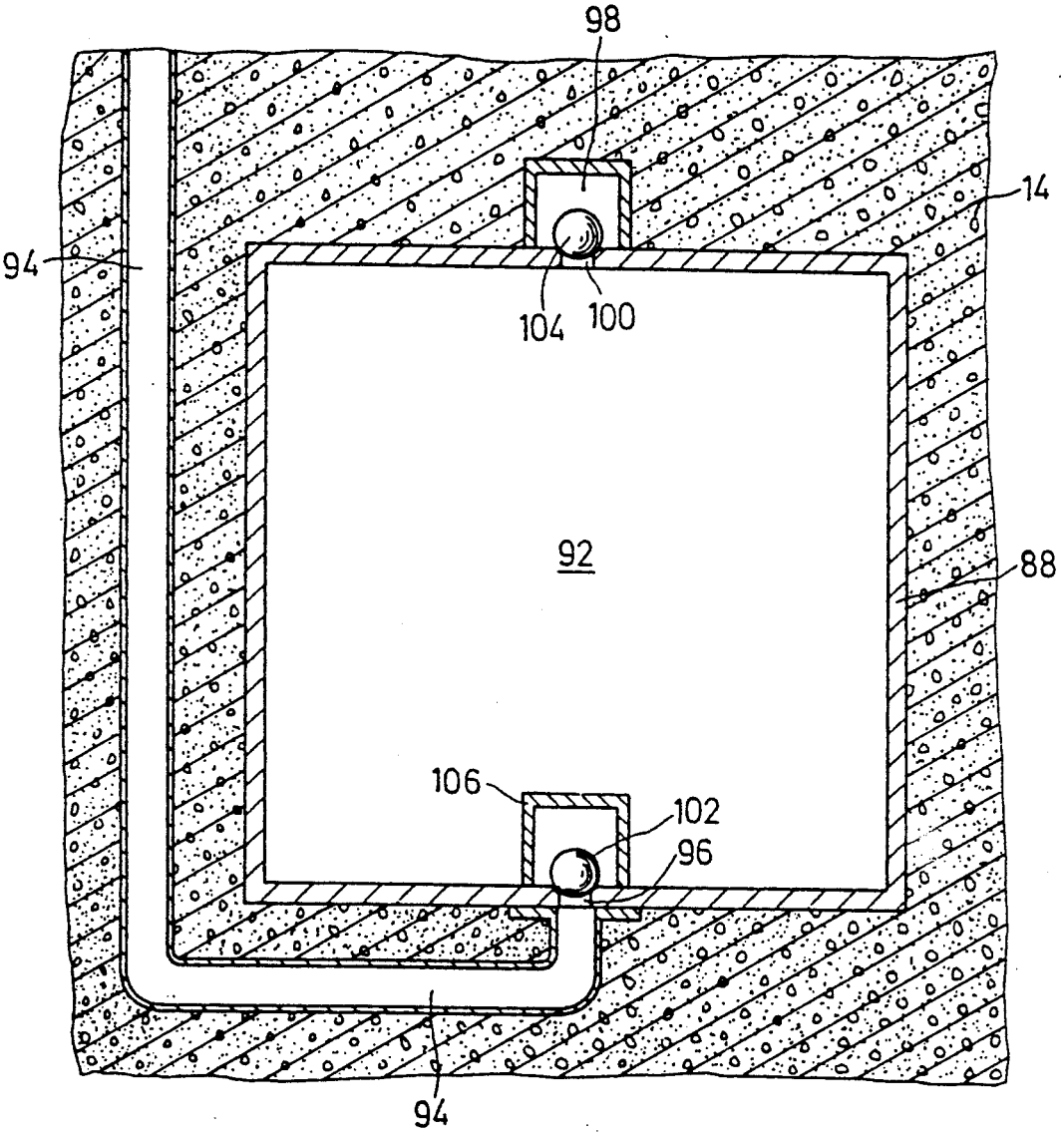
FIG. 7 is a sectional view taken on line 7—7 of FIG. 4.

Please now refer to FIGS. 4 and 7. The air pump 30 embedded in the wall 14 includes a housing 86 having an open end. An elastic, length-changeable soft movable diaphragm 88 is disposed to sealedly cover the open end of the housing 86. A manually operated pull button 90 is fixedly mounted on the movable diaphragm 88. The housing 86 and the movable diaphragm 88 together define a volume-changeable air chamber 92. The housing 86 is formed with an inlet 96 communicating with a ventilating pipe 94 and an outlet 100 communicating with a discharging pipe 98. The inlet 96 and outlet 100 are blocked by a first steel ball 102 and a second steel ball 104 placed thereabove at normal time. The first steel ball 102 is movably located in a restricting shade 106 formed with a vent hole 108. The shade 106 is used to restrict the upward travel of the first steel ball 102 and prevent the steel ball 102 from slipping away. The discharging pipe 98 can similarly prevent the second steel ball 104 from slipping away and an open end 109 of the discharging pipe 98 is disposed on the wall 14 to communicate the discharging pipe 98 with the fire-escaping room 10.

The ventilating pipe 94 is totally embedded in the wall 14 so as not to be burned down by the fire. The ventilating pipe 94 is extended to the top of a building or to a place near the ground where the heavy smoke is not easy to enter. In case a building is provided with several fire-escaping rooms 10, a mutual ventilating pipe can be preset when constructing the building, and several bypass pipes can be set to communicate the mutual ventilating pipe respectively with the ventilating pipes of these fire-escaping rooms 10.

Figure 5:
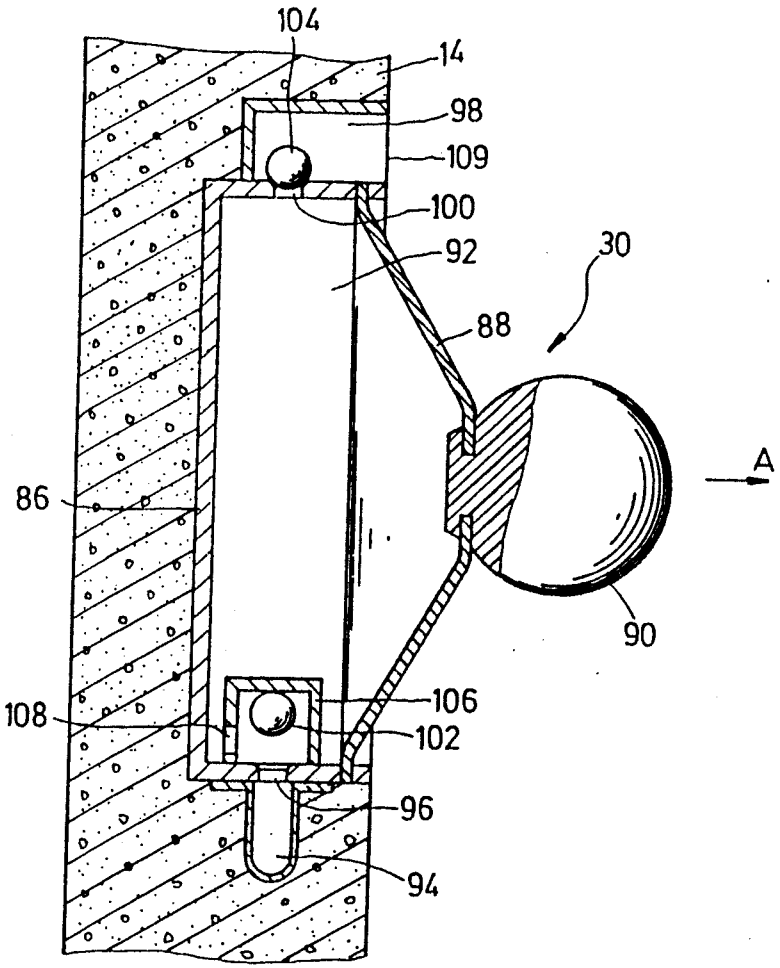
FIG. 5 is a view according to FIG. 4, wherein the movable diaphragm is pulled outward to suck the air from the ventilating pipe into the air pump.

Please now refer to FIG. 5. When the escaping person pulls the pull button 90 outward as indicated by arrow A, the movable diaphragm 88 is pulled outward along therewith to enlarge the volume of the air chamber 92 defined by the housing 86 and movable diaphragm 88. As a consequence, a vacuum suction force is produced to make the first steel ball 102 separate from the inlet 96 and make the second steel ball 104 block the outlet 100 so that the external air in the ventilating pipe 94 is sucked into the air chamber 92 for temporary storage.

Figure 6:
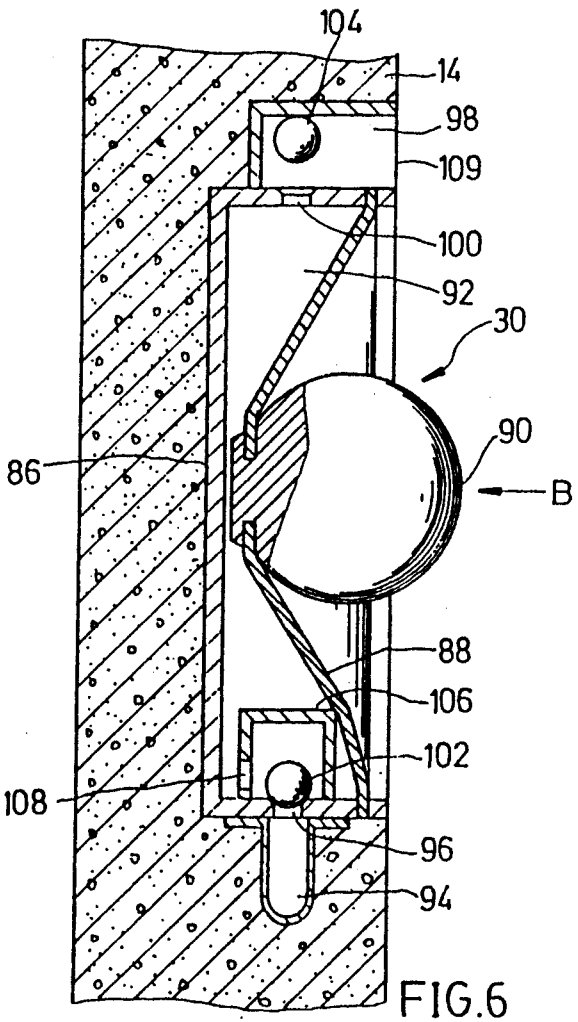
FIG. 6 is a view also according to FIG. 4, wherein the movable diaphragm is pushed inward to compress the air in the air pump and make it flow into the fire-escaping room.

Please now refer to FIG. 6. When the movable diaphragm 88 is pushed back together with the pull button 90 as indicated by arrow B, the volume of the air chamber 92 is reduced to push the temporarily stored air in the air chamber 92, which then pushes the second steel ball 104 upward to separate from the outlet 100. At the same time, the first steel ball 102 blocks the inlet 96 so that the temporarily stored air in the air chamber 92 is discharged from the discharging pipe 98 and enters the fire-escaping room 10.

By means of repeated pulling out/pushing back operation of the pull button 90, the air in the ventilating pipe 94 is continuously sucked into the fire-escaping room 10 through the air chamber 92.

Please refer to FIG. 8. The person 34 entering the fire-escaping room 10 must first shut up the fire-proof door 12 and then pull the ring 74 upward to close the vent holes 64 of the fire-proof door 12 for preventing the outdoor fire and heavy smoke from entering the room 10 and ensuring the safety of the indoor person 34. Before the fire is extinguished and the smoke is dissipated, the person 34 should not leave the room 10. However, if the fire lasts long and the air in the room 10 is insufficient for the person 34 to breathe, the person 34 can repeatedly pull and push the pull button 90 of the air pump 30 with hand so as to suck the external air through the ventilating pipe 94 into the air chamber 92 to be discharged from the open end 109 of the discharging pipe 98 into the fire-escaping room 10. Therefore, the person 34 in the room 10 is protected from dying for lack of air.

Figure 9:
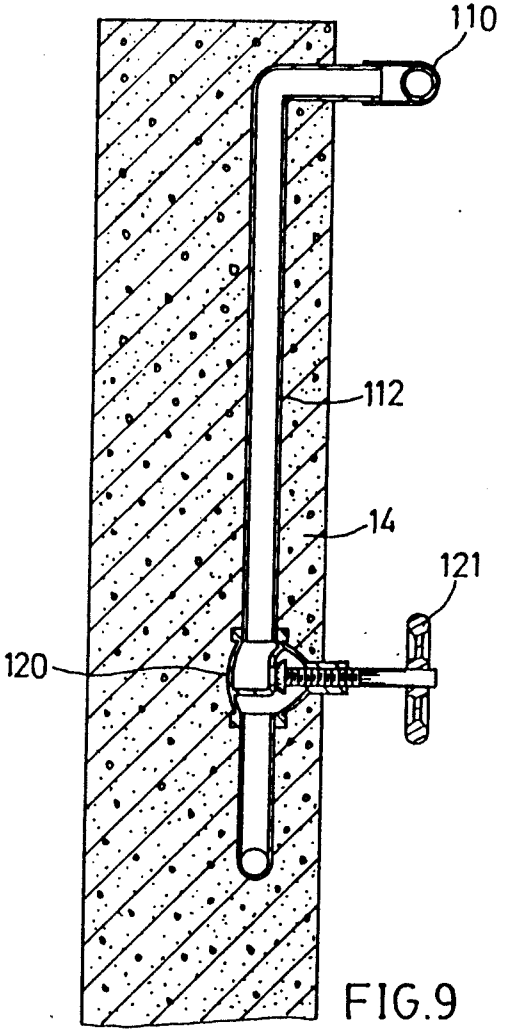
FIG. 9 is an enlarged sectional view taken on line 9—9 of FIG. 1.

Please now refer to FIGS. 1, 9 and 10. Along the top portions of the vertical walls 14 through 17 of the fire-escaping room 10 is disposed a set of circumferential endless sprinkling pipe 32. A part of the sprinkling pipe 32 is removed along with a part of the walls 16, 17 and thus not shown. The sprinkling pipe 32 is connected with a connecting pipe 112 embedded in the wall 14 by a T-shaped connector 110. The connecting pipe 112 is further connected with an incoming pipe 116 by another T-shaped connector 114. The incoming pipe 116 supplies water to a faucet 118 and is a part of the water supply system of the building. Most of the incoming pipe 116 is embedded in the wall 14. The incoming pipe 16 extends upward to a water-storing tower (not shown) disposed on the top of the building. A manually operated controlling valve 120 is disposed on the connecting pipe 112 for conducting/interrupting the water flow. An operating wheel 121 of the controlling valve 120 is disposed outside the wall 14 for the indoor person 34 to operate. A plurality of sprinkling holes 122 are formed on the bottom surface of the sprinkling 32. At normal time, the controlling valve 120 is located at a flow-interrupting position as shown in FIG. 9 so that the water in the incoming pipe 116 will not flow into the sprinkling pipe 32. However, in case a fire occurs and the temperature in the room 10 rises rapidly due to thermal conduction to therefore make the person 34 uncomfortable or hurt the person 34, the person 34 can rotate the operating wheel 121 with hand to rotate the controlling valve 120 to a flow-conducting position so as to permit the water in the incoming pipe 116 to flow through the conducting pipe 112 into the endless sprinkling pipe 32. The water then is sprinkled from the sprinkling holes 122 onto the walls 14 of the room 10 so that the person 34 can keep conscious without physical injury. The accumulated water 126 on the floor 18 is drained from a drainage hole 124 formed on the floor 18. The drainage hole 124 is communicated with the drainage system of the building.

The fire-escaping room 10 of this invention includes a fire-proof door 12 serving as an only entrance/exit. When the fire-proof door 12 is closed, the outdoor fire and heavy smoke are effectively prevented from entering the room 10 to ensure the safety of the person or persons in the room 10. In addition, the fire-escaping room 10 includes a manually operated air pump 30 and a sprinkling pipe 32 whereby in case the air in the room 10 is insufficient, the air pump 30 can be used to suck the external fresh air into the room 10 and in case the temperature in the room 10 is too high, the sprinkling pipe 32 can be used to sprinkle water on the walls and floor of the room 10 to effectively reduce the temperature in the room 10. All the above arrangement can ensure the safety of the person or persons in the room 10. Therefore, in case a fire occurs in a high building or other buildings, the persons in the building no more need to escape from the building at the risk of losing their lives. They only need to pass a shortest way to the fire-escaping room 10 and enter the room 10 to temporarily escape from the fire and wait until the fire is extinguished and the heavy smoke is dissipated. Then they can leave the fire site at ease. As a result, the ratio of the injured and dead in a fire disaster can be minimized.

What is claimed is:

1. A fire-escaping room comprising:

several vertical room walls, a floor and a roof constructed by fire-proof material and together defining said fire-escaping room;

a metal door frame firmly disposed on one of said vertical room walls, said door frame having an inner peripherial surface formed with an inward perpendicularly projecting step portion into which a continuous frame-shaped sealing member being inserted;

a horizontally openable fire-proof door hinged to said door frame and serving as an only entrance/exit of said fire-escaping room whereby when closed, said fire-proof door airtightly abuts against said frame-shaped sealing member to form a completely closed space, said fire-proof door including a metal outer casing and an inner compartmentalizing board which together define an upper chamber and a lower chamber, said upper chamber being filled up with a thermally insulating layer, said lower chamber being formed with several vent holes for ventilating said fire-escaping room, said fire-proof door further including a manually operated slide block set located in said lower chamber, said slide block set being operable inside said fire-escaping room to slide between a first vent hole-closing position and a second vent hole-opening position;

a manually operated air pump embedded in one of said vertical room walls, including a housing having an open end, an elastic soft wovable diaphragm sealedly covering said open end, a manually operated pull button fixedly mounted on said movable diaphragm, an inlet formed on a lower portion of said housing and communicated with a ventilating pipe extending externally, an outlet formed on an upper portion of said housing and communicated with a discharging pipe extending into said fire-escaping room, a first steel ball placed on said inlet to block said inlet and a second steel ball placed on said outlet to block said outlet, said housing and movable diaphragm together defining an air chamber whereby by means of repeatedly pulling/pushing said pull button disposed on said movable diaphragm, the volume of said air chamber is changed to suck external air through said ventilating pipe into said air chamber and then the air in said air chamber is compressed to discharge from said discharging pipe into said fire-escaping room intermittently;

an endless sprinkling pipe disposed around said vertical room walls, said sprinkling pipe being formed with a plurality of sprinkling holes and connected with a water supply incoming pipe by a connecting pipe, a manually operated controlling valve being disposed on said connecting pipe to conduct/interrupt the water flow whereby when said controlling valve is located at a water flow conducting position, the water supplied from said incoming pipe flows into said sprinkling pipe to be sprinkled onto said vertical room walls and said floor; and a draining hole formed on said floor.

2. A fire-escaping room as claimed in claim 1, wherein said slide block set includes an outer frame having an open end, a column disposed in said outer frame through said open end thereof, said column having an inner space filled with a thermally insulating layer, and several compression springs disposed between said outer frame and said column, said springs pushing said outer frame and said column away from each other and making said outer frame and said column respectively closely abut against inner surfaces of said metal outer casing of said fire-proof door.

* * * * *